US005660050A

United States Patent [19]

Wilson et al.

[11] Patent Number: 5,660,050

[45] Date of Patent: Aug. 26, 1997

[54] REFRIGERATION CONDENSER, RECEIVER SUBCOOLER SYSTEM

[75] Inventors: Wilbert J. Wilson, Fullerton, Calif.; Kenneth E. Vogel, Yuma, Ariz.

[73] Assignee: Russell Coil Company, Brea, Calif.

[21] Appl. No.: 500,319

[22] Filed: Jul. 10, 1995

[51] Int. Cl.[6] ..... F25B 49/02

[52] U.S. Cl. ..... 62/125; 62/205; 62/507; 165/110

[58] Field of Search ..... 62/125, 205, 452, 62/454, 455, 456, 506, 507; 165/110, DIG. 193

[56] References Cited

U.S. PATENT DOCUMENTS

| | | | |
|---|---|---|---|
| 1,064,272 | 6/1913 | Wolf . | |
| 1,634,400 | 7/1927 | Davenport . | |
| 1,765,674 | 6/1930 | Inman et al. . | |
| 1,957,036 | 5/1934 | Baars et al. | 165/110 X |
| 2,046,894 | 7/1936 | Candor . | |
| 2,324,649 | 7/1943 | Smith . | |
| 2,361,854 | 10/1944 | McCormack . | |
| 2,706,386 | 4/1955 | Stoner . | |
| 3,238,737 | 3/1966 | Shrader et al. . | |
| 3,753,356 | 8/1973 | Kramer . | |
| 4,457,138 | 7/1984 | Bowman . | |
| 4,936,379 | 6/1990 | Hoshino et al. | 165/110 X |
| 4,972,683 | 11/1990 | Beatenbough . | |
| 5,070,705 | 12/1991 | Goodson et al. . | |
| 5,076,353 | 12/1991 | Haussmann | 165/110 |
| 5,379,833 | 1/1995 | Mathews | 165/113 |

FOREIGN PATENT DOCUMENTS

| | | | |
|---|---|---|---|
| 374895 | 6/1990 | European Pat. Off. | 165/110 |

*Primary Examiner*—Harry B. Tanner

*Attorney, Agent, or Firm*—Knobbe Martens Olson & Bear, LLP

[57] ABSTRACT

The refrigeration system is provided with a bundle of refrigeration tubes extending through heat exchange fins, with the bundle forming a condenser section, a receiver section and a subcooler section. A sight glass is positioned in the line between the receiver and the subcooler to facilitate the refrigerant charging process. The system also includes a floating head arrangement which allows the condenser pressure to fluctuate with the ambient temperature. A solenoid valve leading to an expansion valve cycles on/off in response to compressor suction pressure. A check valve insures that a column of liquid is always immediately upstream from the expansion valve.

13 Claims, 3 Drawing Sheets

REFRIGERATION CONDENSER, RECEIVER SUBCOOLER SYSTEM

FIELD OF THE INVENTION

This invention relates to refrigeration apparatus and more particularly to a condenser, receiver and subcooler arrangement.

BACKGROUND OF THE INVENTION

Refrigeration systems typically have a condenser and a receiver downstream from the condenser as separate components. Also, these systems frequently include a subcooler as a separate component downstream from the receiver, but in heat exchange relation with a condenser. A receiver is employed to provide for storage of a volume of refrigerant sufficient to accommodate for variations in system operating conditions and loss of refrigerant. When a system is not in operation, most of the refrigerant is contained in the receiver. Ideally, the refrigeration system will have only the amount of refrigerant in it to accommodate its various operating conditions. This ideal amount can be calculated, and installers of refrigeration systems are advised to charge the system with only that quantity of refrigerant. However, a typical receiver has capacity for storing considerably more refrigerant than what is needed and installers often charge systems with much more than what is needed simply to be certain that there is enough. However, over-charging is undesirable. Also, over-charging, of course, in effect wastes refrigerant and adds to the cost of the system. With inexpensive refrigerants, this may not have been a very significant factor; however, because of environmental concerns, it is now required that different refrigerants are to be employed, and they are more expensive.

The quantity of refrigerant required is also affected by the construction of a conventional receiver. Basically the receiver comprises a container in which liquid refrigerant collects. An outlet tube for withdrawing liquid from the receiver typically extends through an upper wall of the receiver and has an open lower end positioned in the liquid. In order to withdraw only liquid from the receiver, it is necessary that the open lower end be always covered by liquid. Hence, it is necessary that there always be sufficient liquid in the receiver to cover the mouth of the tube. That quantity is essentially an unproductive percentage of the refrigerant from the cooling standpoint.

Another type of receiver simply has an outlet in the lower portion of the container. That type may require smaller minimum amount in the container, but it is undesirable to let the liquid level fall too close to the outlet because there is a vortex effect or tendency for vapor to be drawn into the outlet when the outlet gets close to being uncovered by liquid.

U.S. Pat. No. 4,972,683 discloses an automotive refrigerant condenser that instead of having a separate receiver and a separate subcooler, incorporates those components into a condenser. The particular construction employed, however, is not consistent with that normally used in commercial refrigeration systems. Also, there is no provision in that system to indicate how much refrigerant is to be employed. Presumably, the calculation method would be utilized.

U.S. Pat. No. 5,379,833 discloses a condenser and a subcooler as an integrated unit, with a large capacity receiver between the two also functioning as a vertical header for the condenser. The refrigerant charging procedure is not discussed, but apparently the receiver is large enough to hold all the refrigerant.

Another approach for determining when adequate refrigerant has been injected into a system is to employ sight glasses through which an installer can observe bubbling through the sight glasses which indicates vapor and liquid flowing through the conduit, or observe no bubbling which indicates that only liquid is flowing through the conduit. U.S. Pat. No. 3,753,356 discloses several systems employing sight glasses. It mentions that in one prior system a receiver has been equipped with numerous sight glasses or valve taps at various levels, or with a single vertical sight glass, connected to the vessel at two levels, to determine the level of liquid refrigerant. As an improvement, that patent suggests having a flow-through sight glass at the inlet to a receiver and a second sight glass at the outlet from the receiver. The patent indicates that if there are no bubbles through the sight glass at the outlet there is adequate refrigerant in the system. Further, if no bubbling is seen through the sight glass at the inlet to the receiver, the user knows that there is too much refrigerant in the system. A difficulty with this arrangement is that the difference between just enough refrigerant and too much is equal to a large percentage of the receiver volume. That is, even if the receiver is almost full of refrigerant, bubbles could still be observed through the sight glass at the inlet to the receiver. Yet the system would have much more refrigerant than desired.

Another arrangement illustrated in U.S. Pat. No. 3,753,356 does not include a receiver and has refrigerant flowing directly from the condenser to a subcooling coil, with a sight glass between those two components and with a second sight glass at the outlet of the subcooler. The patent indicates that bubbling in the sight glass at the outlet of the condenser with no bubbling at the outlet of the subcoil would be an indication that the proper amount of refrigerant is in the system. However, bubbles in the subcooler are undesirable in order to maximize the subcooling effect.

It is believed that a need exists for an improved condenser construction and method that will maximize the condenser capacity while minimizing the refrigerant required. Also needed is a simplified technique for determining when there is enough refrigerant in the system.

SUMMARY OF THE INVENTION

Briefly stated, the preferred form of the condenser of the invention utilizes a bundle of parallel tubes extending between support plates with at least some of the tubes having a plurality of fins positioned on them in heat exchange relation. A sufficient number of tubes are employed to provide a normal condenser function as well as a receiver function. In addition, in a preferred arrangement, tubes are also provided to form a subcooler function. This eliminates the need for a separate receiver and a separate subcooler.

To enable an installer of a refrigeration system to know how much refrigerant to be added to this system, a sight glass is provided at the juncture between the receiver and the subcooler sections. Bubbles in the refrigerant are visible so long as additional refrigerant is needed. When the bubbles disappear, there is sufficient refrigerant in the system. Thus, the installer merely has to monitor the sight glass as the refrigerant is being added to determine when to stop. Similarly, the sight glass may be checked periodically to see if more refrigerant is needed.

in addition to eliminating the need for a separate receiver, a primary advantage of the system is that the receiver portion of the condenser can function as a condenser during normal operation. Thus, heat exchange capacity has been added to the receiver condenser, namely a finned receiver. The refrigerant storage function capacity is retained, but it is moved from a separate tank into additional condensing tubes. The system thus provides greater heat transfer capacity which means energy savings. Further, the reduced refrigerant requirement provides further savings, all of which means lower operating costs.

In a preferred arrangement, one or more inlet and outlet headers are employed for the initial section of the condenser which might be thought of as the normal condenser. In addition, one or more inlet and outlet headers for the tubes may be provided for the receiver section. Similarly, the tubes forming the subcooler section may be joined by one or more inlet and outlet headers. It should be pointed out, however, there are no significant pressure drops throughout the condenser/receiver/subcooler assembly as occurs, for example, with conventional receiver design.

DETAILED DESCRIPTION OF A PREFERRED EMBODIMENT

Figure 1:
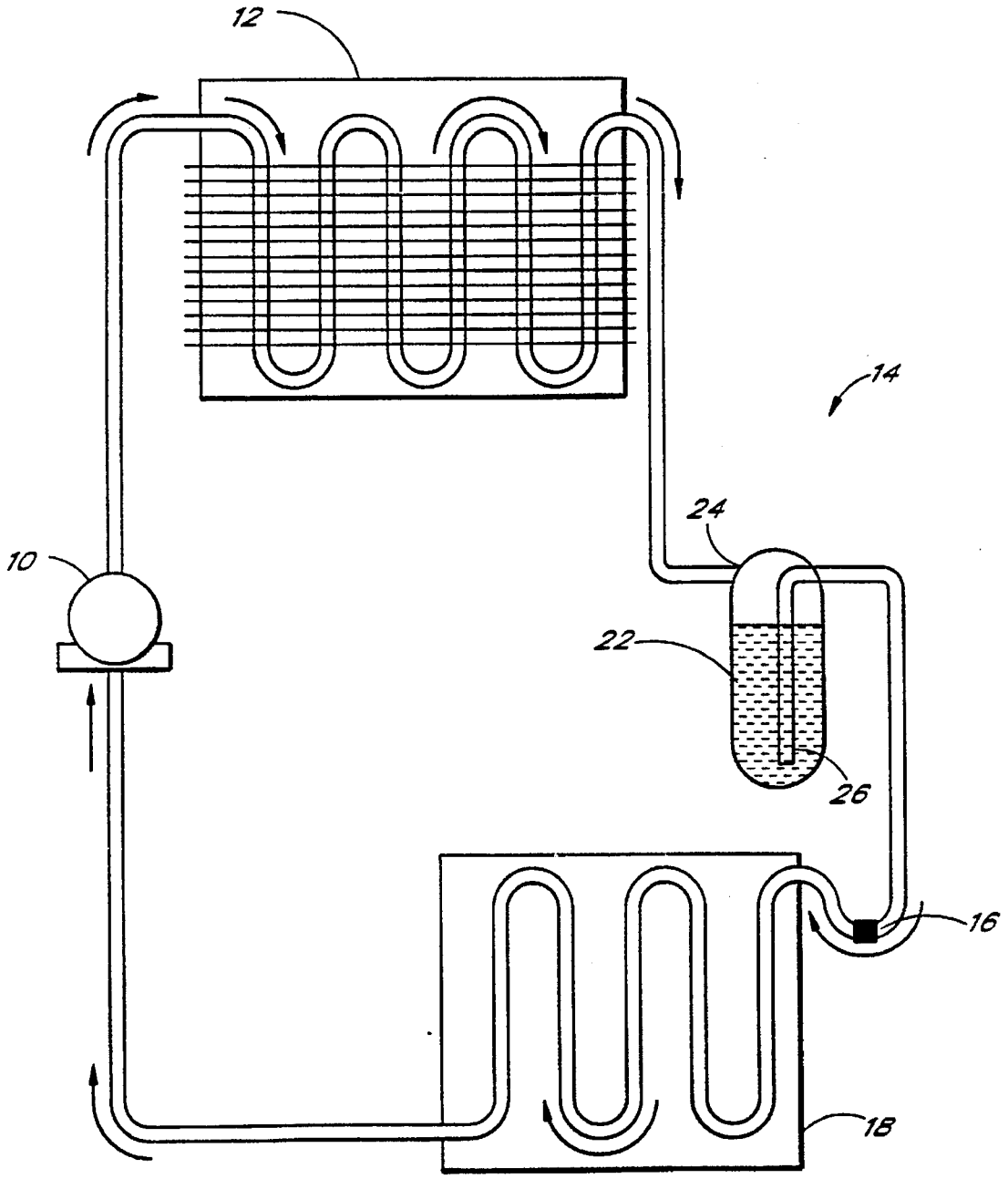
FIG. 1 (PRIOR ART)
FIG. 1 schematically illustrates a prior art refrigeration system.

The prior art refrigeration system of FIG. 1 employs a compressor 10 serially connected to a condenser 12, a receiver 14, an expansion valve 16, and an evaporator 18 that has its output returning to the compressor 10. The receiver 14 is of a conventional type having a container 22 with an conduit 24 and an outlet conduit 26 near the bottom of the container. A combination of liquid refrigerant and gaseous refrigerant may enter the receiver, but only liquid refrigerant should be withdrawn from the receiver to the evaporator. Many prior art systems also employ a subcooler coil 26 connected to the output of the receiver and positioned in heat exchange relation with the condenser 12.

Figure 2:
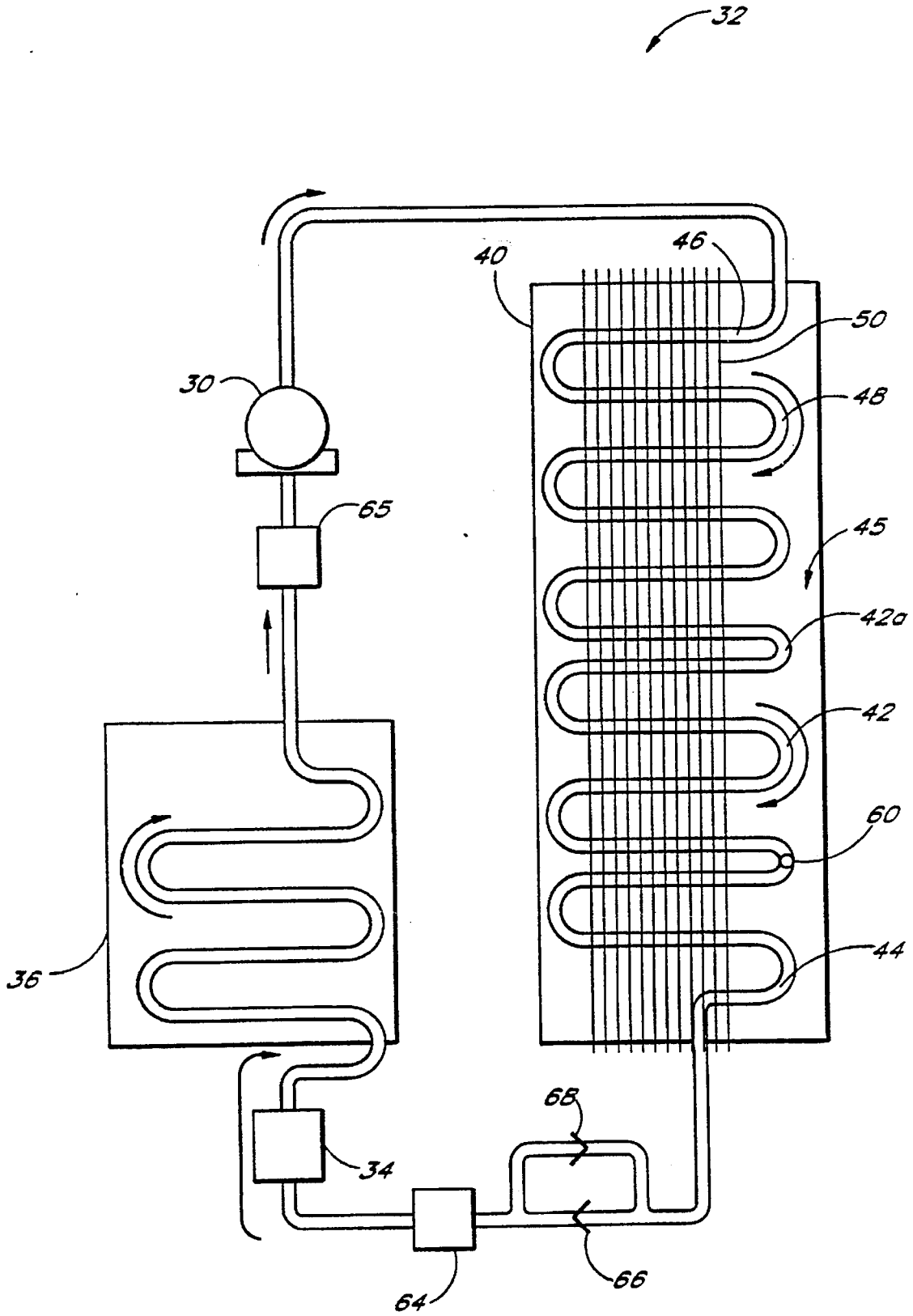
FIG. 2 schematically illustrates the refrigeration system of the present invention.

FIG. 2 schematically illustrates the refrigeration system of the present invention. It employs a conventional compressor 30 having its output connected to a specially designed condenser, receiver, and subcooling assembly 32, with its output connected to a conventional expansion valve 34 and conventional evaporator 36. The assembly 34 includes a condenser section 40, a receiver section 42, and a subcooling section 44. Physically, the condenser comprises a bundle of tubes having spaced parallel straight portions joined by end turns, with spaced parallel fins extending perpendicular to the straight portions of the tubes. The condenser receiver and subcooler sections are formed as one continuous bundle of tubes without any significant pressure drops between them. Further, all of the tubes in the bundle may pass through the same heat exchange fins and the three sections may be manufactured as a single assembly.

The condenser is sized to provide the capacity needed for what might be thought of as a normal condenser function for the system. The receiver section is sized to provide the desired receiver function; however, the receiver advantageously also functions to provide additional condenser capacity. The subcooler is sized to provide the desired subcooling function, but advantageously is integrally formed with the other two sections to provide manufacturing advantages.

A sight glass 60 suitable to allow observation of flowing refrigerant is provided at the juncture between the receiver and the subcooler sections. A major advantage of the system illustrated is that the single sight glass enables the system to be easily charged with the proper amount of refrigerant. As the refrigerant is being added to the system, bubbles are visible in the sight glass so long as additional refrigerant is needed. When the bubbles disappear, there is sufficient refrigerant in the system. Thus, the installer merely has to monitor the sight glass as the refrigerant is being added to determine when to stop. Similarly, the sight glass may be checked periodically to see if more refrigerant is needed. Thus, with this arrangement, the installer need not make calculations to determine the amount of refrigerant needed nor does the installer need to add extra amounts of refrigerant in order to make sure there is an adequate amount. Thus, the refrigerant cost is minimized. It should also be noted that with the receiver illustrated in FIG. 2, there is no minimum refrigerant required to make it function, as with the prior art arrangement illustrated in FIG. 1. That is, a certain minimum amount of refrigerant is required in the receiver of FIG. 1 at all times to prevent liquid from leaving the receiver; hence that quantity is essentially wasted from a cost standpoint.

Figure 3:
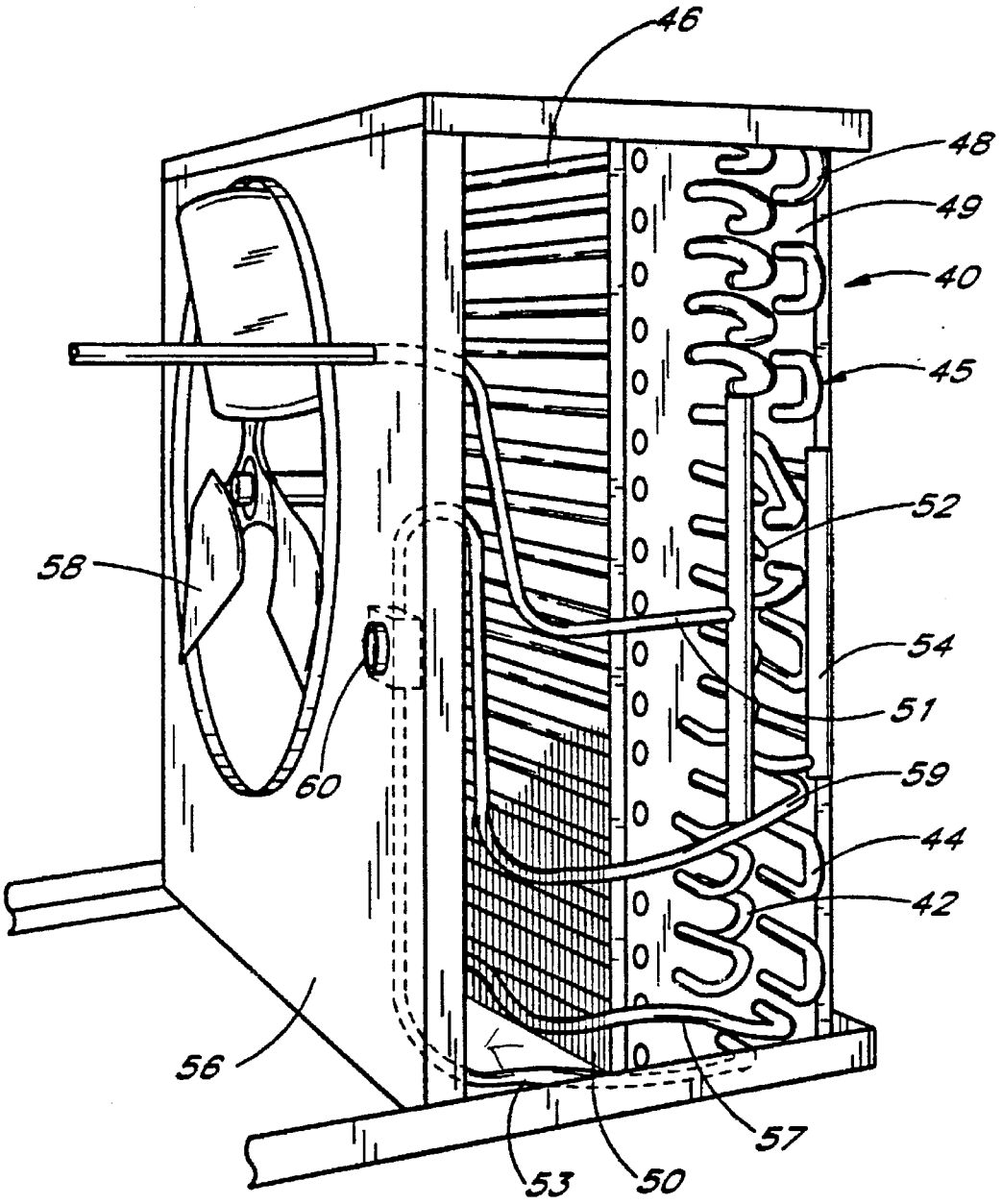
FIG. 3 is a perspective, more physical, but still somewhat schematic view of the system of FIG. 2.

As may be seen from FIG. 3, the tubes 45 extend through an endsplate 49 with the tubes forming the condenser section 40 being physically located at the upper portion of the assembly to receive the hot refrigerant from the compressor outlet conduit 51 leading to the header 52. The output from the condenser 40 flows to a receiver inlet header 54 leading to the tubes of the receiver 42 which is located in the lower portion of the assembly. The output from the receiver flows through outlet conduit 53 to the sight glass 60 which is conveniently mounted in a panel 56 surrounding a fan 58, which draws air through the tube coils. The subcooler 44 is located adjacent to the receiver coils with a conduit 59 from the sight glass being connected to the upper, inlet end of the subcooler which is adjacent to the inlet to the receiver. An outlet conduit 57 from the subcooler is at the lower end of the tube bundle.

It should be noted that the liquid line outlet 53 of the receiver section is at the lowest point of the receiver to ensure that only liquid is entering into the highest point of the subcooler section inlet line 59. The subcooler outlet 57 is again at the lowest point to ensure a solid column of liquid is supplied to the expansive valve.

The number of tubes in the three tube sections will of course depend on the size of the overall refrigeration system. However, in a preferred form of the invention, approximately 70% of the tubes in the tube bundle are calculated to be the normal condenser section, about 20% of the tubes are calculated to form the receiver section, and the balance of 10% forms the subcooler section. With that arrangement, the entire receiver section is available to provide condenser capacity during operation of the system, but yet when the maximum capacity is not required, the excess refrigerant is collected in the receiver section. Thus, in operation, the system might be thought of as a receiverless system. Conversely, it could be thought of as a system employing a finned receiver.

Overall the condenser/receiver assembly 32 provides a nominal 25% increase in heat transfer capacity. This is done with a refrigerant charge that is up to 10 percent less than typical. This provides energy savings and decreased operating costs.

Utilizing the integrated finned receiver and sight glass arrangement of the present invention in combination with a known floating head system optimizes conservation of refrigerant and energy. In any refrigeration system that rejects condenser heat to ambient air, the condensing pressure/temperature is related to the temperature of the air entering the condenser. The ambient temperature, of course, fluctuates greatly in many geographical areas.

As the ambient temperature drops, so does the condensing pressure. The condenser pressure is the force that drives the refrigerant through the expansion valve. If this pressure becomes too low, the refrigeration system will not function, even though it is cold outside. Most conventional systems for solving this problem are not energy efficient and was designed in an era when energy cost were quite low.

As a result a so called floating head system was developed which attempts to allow condenser pressure to fluctuate with the ambient temperature. Such a system is schematically illustrated in FIG. 2. It includes a specially designed expansion valve 34 that only requires a minimum of about twenty five pounds differential pressure to operate. This allows the compressor to operate much more efficiently and at the same time consume less energy.

Operating at low discharge pressure means low pressure on the liquid in the receiver section 42; and without subcooling, any warming of the liquid flow results in flash gas. Flash gas entering the expansion valve 34 will choke it so that proper feeding of the refrigerant cannot be maintained. Thus the subcooling of the system of FIG. 2 is necessary.

On low temperature systems, the compressor will usually be overloaded during the initial start up of the system or right after a defrost cycle. To protect against excess overload, a pressure control 65 is provided to cycle a liquid line solenoid valve 64 leading to the expansion valve. The solenoid valve is cycled on and off in response to compressor suction pressure. Once the system's suction pressure is normal, this cycling stops.

Another potential start up problem occurs in very cold ambient when refrigerant in the receiver and condenser drops to very low pressure during an off cycle. In that situation, there is inadequate pressure available to facilitate the flow of refrigerant, when the system needs to be started. To compensate for that, there is provided a check valve 66 in the liquid line leading to the evaporator. The check valve retains a solid column of liquid in the liquid line between the check valve and the solenoid valve 64. This column of liquid will generally increase in pressure during an off cycle, so that the expansion valve is assured of having a supply of liquid at adequate pressure to feed the evaporator with enough refrigerant to bring the suction pressure up to where the system can react. Since an increase in temperature of a solid column of liquid can result in hydro-static pressure, a pressure relief valve 68 is supplied in parallel with the check valve to relieve the pressure in the opposite direction of the check valve. The fan 58 (FIG. 3) controlling air flow through the condenser 40 can also be kept off until there is adequate head pressure to resume normal system operations.

This floating head pressure design requires less refrigerant than other systems employed to overcome the low temperature situation discussed above. Thus, the floating head system in combination with the improved condenser/receiver/subcooler system of the invention is particularly advantageous from the standpoint of minimizing the quantity of refrigerant and energy required.

We claim:

1. A refrigeration system, comprising:

a condenser having a refrigerant line with an inlet and an outlet and with one or more tubes in between the inlet and outlet, and with heat exchanger fins in heat exchange relation with the tubes;

a receiver including a refrigerant line with an inlet at the outlet of the condenser and an outlet downstream from the receiver inlet, and with said receiver having one or more tubes between the receiver inlet and receiver outlet, said receiver being adapted to function as additional condenser capacity during normal operation of said system and being adapted to store excess refrigerant in the receiver line when the system is not in operation; and a flow-through sight glass situated in the receiver line substantially at the receiver outlet to permit observation of the refrigerant at that location as an indication of the appropriate amount of refrigerant in the line.

2. The system of claim 1, including a subcooler coil having a refrigerant line with an inlet at the outlet of the receiver and an outlet downstream from the subcooler inlet, said sight glass being positioned between the receiver and the subcooler.

3. The system of claim 2, wherein said receiver outlet is located and at a lower level than said receiver inlet so that only liquid enters the subcooler.

4. The system of claim 3, wherein the outlet from the subcooler is located at a lower level than the subcooler inlet so that only liquid is supplied to a downstream expansion valve.

5. The system of claim 2 wherein said condenser, said receiver, and said subcooler are formed from a bundle of heat exchange tubes, including a plurality of straight sections joined by end curved sections and forming refrigerant gas flow paths, said condenser being formed by a first section of the bundle, said receiver being immediately downstream of said condenser and formed by a second section of the bundle, and said subcooler being positioned immediately downstream from said receiver and formed by a third section of the bundle; and said system including a plurality of heat dissipating fins connected to the straight bundle sections of at least the condenser and the receiver.

6. The assembly of claim 2, including an evaporator expansion valve downstream from the subcooler, and wherein an inlet to the receiver is higher than an outlet from the receiver, and an inlet to the subcooler is higher than an outlet from the subcooler.

7. The system of claim 1, including:

a pair of spaced plates, supporting said tubes and fins.

8. The system of claim 1, wherein said condenser and said receiver are formed from a bundle of heat exchange tubes, including a plurality of straight sections joined by end curved sections and forming refrigerant gas flow paths, said condenser being formed by a first section of the bundle; and said receiver being formed by a second section of said bundle; and said system including a plurality of heat dissipating elements connected to the bundle straight sections of the condenser and the receiver.

9. A method of maximizing condenser capacity in a commercial refrigeration system while minimizing the quantity of refrigerant required, comprising:

forming a commercial refrigeration condenser sufficiently large so that a downstream section of the condenser will provide extra condenser capacity or function as a receiver; and positioning only a single sight glass in a refrigerant line between said condenser and an evaporator expansion valve downstream from the condenser, the sight glass being located in the refrigerant line immediately downstream of said section to enable the absence of bubbles in the refrigerant line to be observed through the sight glass as an indication that there is sufficient refrigerant in the system.

10. The method of claim 9, including making the condenser sufficiently large so that a section of the condenser downstream of the receiver can function as a subcooler of the refrigerant after it has been liquified.

11. A refrigeration system, comprising:

a condenser having a refrigerant line with an inlet and outlet and with one or more tubes between the inlet and outlet, and with heat exchanger fins in heat exchange relation with the tubes;

a receiver including a refrigerant line with an inlet at the outlet of the condenser and an outlet downstream from the receiver inlet, and with said receiver having one or more tubes between the receiver inlet and receiver outlet, said receiver being adapted to function as additional condenser capacity during normal operation of that system and being adapted to store excess refrigerant in the receiver line when the system is not in operation;

a flow-through sight glass situated in the receiver line substantially at the receiver outlet to permit observation of the refrigerant at that location as an indication of the appropriate amount of refrigerant in the line; and an evaporator expansion valve downstream from the receiver, a one-way valve between the receiver and the expansion valve permitting flow to the expansion valve but preventing flow in the opposite direction, and a relief valve connected in parallel to the one-way valve to relieve pressure built-up by the refrigerant between the expansion valve.

12. A commercial refrigeration system comprising:

a condenser, a receiver, and a subcooler formed from a bundle of tubes, including a plurality of straight sections joined by end curved sections and forming refrigerant gas flow paths, said tube straight sections extending through and being supported by a pair of spaced support plates, said condenser being formed by a first section of the bundle, said receiver being immediately downstream of the condenser and formed by a second section of the bundle, said receiver being adapted to function as additional condenser capacity during normal operation of said system and being adapted to store excess refrigerant in the receiver line when the system is not in operation, said subcooler being positioned immediately downstream from said receiver and formed by a third section of the bundle, a plurality of heat dissipating fins connected to said straight bundle sections; and a flow-through sight glass positioned in the refrigerant gas flow path between an outlet of the receiver section and an inlet of the subcooler to observe the presence or absence of bubbles in refrigerant flowing through the refrigerant line at that location; and an evaporator expansion valve downstream from the subcooler, with no sight glass being positioned in the refrigerant flow line between the expansion valve and the subcooler.

13. The assembly of claim 12 including a one-way valve between the subcooler and the expansion valve permitting flow to the expansion valve but preventing flow in the opposite direction, and a relief valve connected in parallel to the one-way valve to relieve pressure built up by the refrigerant between the one-way valve and the expansion valve.

* * * * *